US007819046B2

(12) United States Patent
Ohlson

(10) Patent No.: US 7,819,046 B2
(45) Date of Patent: Oct. 26, 2010

(54) METHOD AND ARRANGEMENT FOR THE DESTRUCTION OF EXPLOSIVE-FILLED OBJECTS

(75) Inventor: Johnny Ohlson, Kil (SE)

(73) Assignee: Olcon Engineering AB, Kil (SE)

( * ) Notice: Subject to any disclaimer, the term of this patent is extended or adjusted under 35 U.S.C. 154(b) by 4 days.

(21) Appl. No.: 12/293,106

(22) PCT Filed: Feb. 19, 2007

(86) PCT No.: PCT/SE2007/000144

§ 371 (c)(1),
(2), (4) Date: Oct. 8, 2008

(87) PCT Pub. No.: WO2007/106008

PCT Pub. Date: Sep. 20, 2007

(65) Prior Publication Data

US 2009/0071319 A1 Mar. 19, 2009

(30) Foreign Application Priority Data

Mar. 16, 2006 (SE) ..... 0600577-1

(51) Int. Cl.
*F42B 33/00* (2006.01)

(52) U.S. Cl. ..... 86/50

(58) Field of Classification Search ..... 86/50; 102/312, 313

See application file for complete search history.

(56) References Cited

U.S. PATENT DOCUMENTS 2,892,405 A * 6/1959 Dewey ..... 166/299
2,917,927 A * 12/1959 Clark ..... 73/865.6
3,163,112 A * 12/1964 Rhea ..... 102/310
3,820,435 A * 6/1974 Rogers et al. ..... 89/1.1
3,986,430 A * 10/1976 Coursen et al. ..... 86/20.15
4,046,055 A 9/1977 McDanolds et al.
4,187,758 A * 2/1980 Petty ..... 86/50
4,253,523 A * 3/1981 Ibsen ..... 166/299
5,103,912 A * 4/1992 Flint ..... 166/297
5,192,819 A * 3/1993 Baumgartner ..... 86/20.15
5,400,856 A * 3/1995 Schmidt ..... 166/271
5,551,344 A * 9/1996 Couet et al. ..... 102/312
5,668,342 A * 9/1997 Discher ..... 86/50
6,173,662 B1 * 1/2001 Donovan ..... 110/237
7,073,424 B2 * 7/2006 Ferrari et al. ..... 86/50
7,243,725 B2 * 7/2007 George et al. ..... 166/299
7,373,867 B2 * 5/2008 Ryan ..... 86/50
7,506,568 B2 * 3/2009 King ..... 86/50
2004/0107824 A1 * 6/2004 Ferrari et al. ..... 86/50
2005/0222484 A1 * 10/2005 Eidelman et al. ..... 588/403
2009/0044692 A1 * 2/2009 Ivany et al. ..... 86/50

FOREIGN PATENT DOCUMENTS

WO WO-9600880 1/1996
WO WO-2006049550 5/2006

* cited by examiner

*Primary Examiner*—Bret Hayes
*Assistant Examiner*—Reginald Tillman, Jr.
(74) *Attorney, Agent, or Firm*—Connolly Bove Lodge & Hutz LLP

(57) ABSTRACT

The present invention relates to a method and an arrangement in the destruction of explosive-filled objects (8), such as various types of ammunition components, in a detonation chamber (1) intended for this purpose, for ensuring that the constituent explosives of the material for destruction are rapidly made to detonate at the most advantageous point in the detonation chamber with regard to the wear and tear on the detonation chamber.

9 Claims, 1 Drawing Sheet

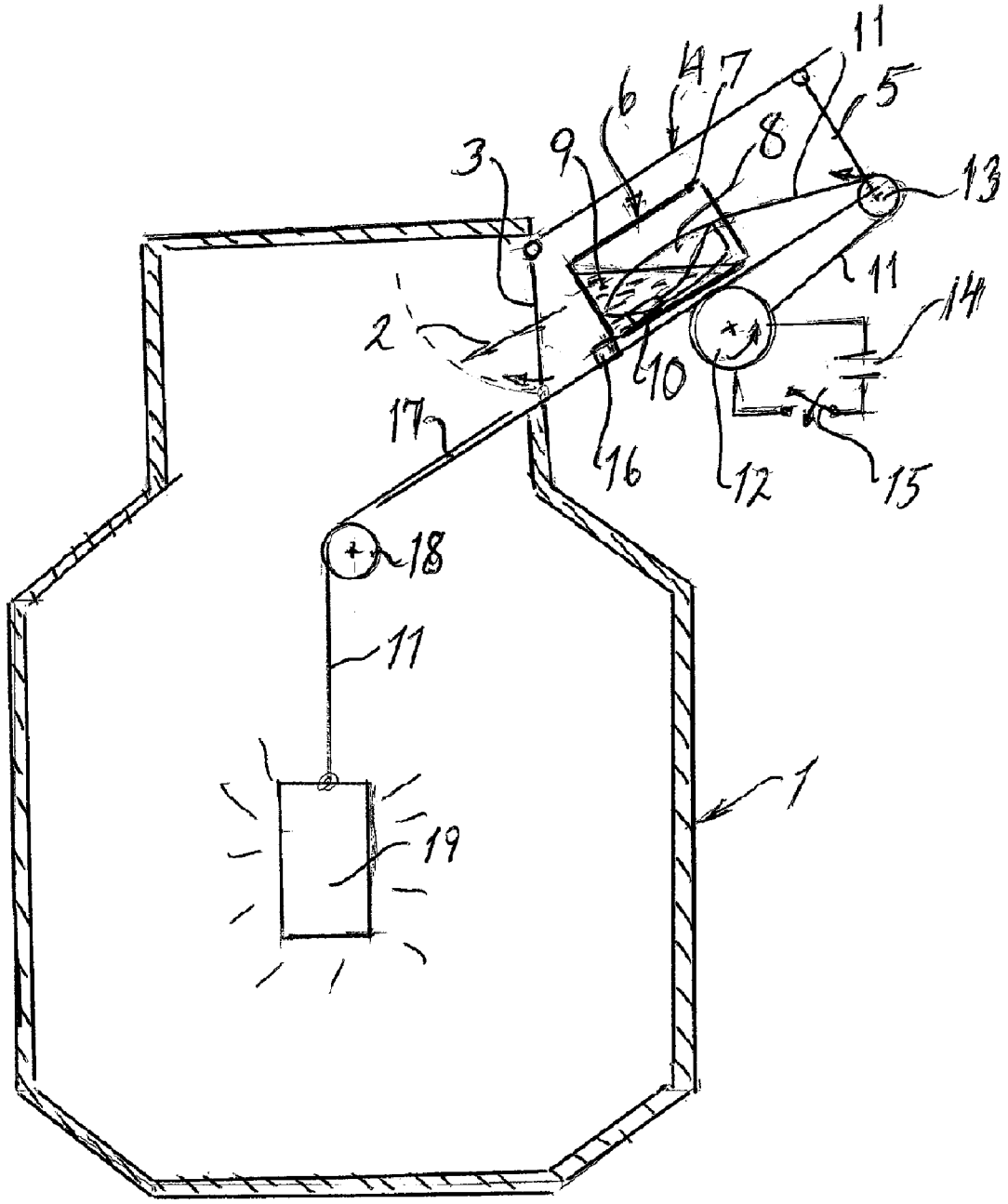
11
4
7
6
5
3
9
8
13
11
14
2
10
17
16
12
15
18
11
1
19

METHOD AND ARRANGEMENT FOR THE DESTRUCTION OF EXPLOSIVE-FILLED OBJECTS

This application is a National Stage of PCT/SE2007/000144 filed Feb. 19, 2007 which in turn claims priority from Swedish Application 0600577-1 filed Mar. 16, 2006, entire disclosures of which are incorporated herein by reference.

The present invention relates to a method and an arrangement for the destruction of explosive-filled objects by detonation and combustion of the constituent explosives in a destruction or detonation chamber intended for this purpose. The invention is primarily intended for use in the destruction of somewhat larger explosive-filled objects, such as medium and large-calibre artillery projectiles and other similar objects with a high explosives content, although it can also advantageously be used for the destruction of multiple smaller objects in batches.

The invention is furthermore especially suitable for use in the destruction of those explosive-filled objects that may be difficult to detonate rapidly solely by external heating. Examples of such objects include artillery shells with thick casings originally intended as fragmentation shells. Other examples of objects that can be suitably destroyed by the method according to the present invention are explosive-filled objects, the explosives content of which has reached a stage where their capacity for initiation solely through external heating is regarded as doubtful due to inappropriate storage, for example, or an extremely long storage time. The method according to the invention can also advantageously be used in starting up a continuous destruction of explosive-filled objects, which are to be fed, successively or in batches, to a destruction chamber intended for this purpose, which on starting up has accordingly not yet been charged with enough hot scrap to allow material subsequently delivered for destruction to be automatically supplied with sufficient heat to enable the constituent explosives to detonate spontaneously.

A particular advantage of the method according to the invention is that it also helps to reduce the wear and tear to the destruction chamber in which destruction is carried out.

Since the passing of the cold war, there are at many locations throughout the world large stocks of old, obsolete ammunition such as artillery shells, land mines etc., which no longer fulfil any function and which it would be best to dispose of, and which can hardly be scrapped in any way other than by detonation and burning. This may involve cartridge ammunition which is of too small a calibre to allow it to be cost-effectively dismantled, or those ammunition components which through protracted storage under unfavourable conditions have become far too unsafe for anybody to dare to dismantle them and to melt out the constituent explosives. Another factor is the desire to capitalize on all valuable scrap metal which these ammunition components generally contain.

From once having detonated such ammunition out in the open or sunk it out at sea, in deep waters or in abandoned mines, where the environmentally harmful components which it as often as not contains could over time have contaminated the environment, fortunately we have now largely gone over to destroying it, that is to say detonating such surplus ammunition in special, purpose-made destruction facilities, which make it possible to utilize all the scrap formed in the process and to purify all the environmentally harmful combustion gases simultaneously generated. The destruction is performed as a combined detonation and combustion process, which destroys all the explosives that once went into the original ammunition, the end product therefore being harmless scrap metal, which can be recycled.

The basic principle of the actual destruction facilities used in this context is that the main part of such facilities comprises an explosion-proof and gas-tight detonation chamber inside which the material for destruction, containing explosives, is detonated and/or burned so that all constituent metallic material originally enclosing the explosive is converted into harmless scrap metal fragments, whilst any plastics or rubber components or other combustible components are burned. The explosive in the material for destruction is normally made to detonate by external heating and, especially in continuously operating destruction facilities to which new material for destruction is fed in batches, a proportion of the hot scrap metal from previously destroyed material is usually retained in the bottom of the detonation chamber and used for transmitting heat and heating up the next batch of material for destruction to a suitable initiation temperature, which in the case of TNT charges, for example, can be calculated as approximately 550 degrees C. In such continuous destruction processes the material for destruction is therefore thrown via a protective lock down into the previously formed bed of hot scrap, which takes on the function both of a heat source and of a certain safeguard for the interior of the detonation chamber, and this more general basic method works excellently as long as the actual explosive in the material for destruction is not enclosed by too thick a protective casing, which prevents the explosive from reaching the detonation temperature in a reasonable time, or the explosive is of such questionable quality that it is difficult to detonate.

According to the present invention an initiation charge is now first added to the material for destruction, which instead of been thrown down into a bed of hot scrap is then lowered or hoisted down into the detonation chamber suspended on a line or cable intended for this purpose to a point close to the centre of the detonation chamber, where the initiation charge is activated, with the result that the actual explosives content of the material for destruction is detonated. One of the basic principles of this method of destroying explosive-filled objects is furthermore that the cable used for lowering the material for destruction down into the detonation chamber also serves as the electrical ignition cable for the electrically activated initiation charge.

In a further development of the invention the material for destruction is not only supplemented by an electrical igniter but also has a regular initiation charge added to it, which is brought into close proximity with the material for destruction. This may be done, for example, as is specifically proposed in a further development of the invention, by packing the material for destruction into a simple container or box before delivering it to the detonation chamber, the container being at least partially filled with an inexpensive slurry or gel explosive, in which the electrical igniter according to the idea of the invention is placed. Placing the material for destruction in such a container or box together with an additional initiation charge affords several advantages, including an assured initiation of the constituent explosive in the material for destruction, even if it should be of poor quality. At the same time it is possible to selectively consign one or more objects for destruction, and the containers or boxes used for this purpose can be provided from the outset with suitable attachment points for the combined ignition and lowering cable.

The invention has been more closely specified in the following patent claims and will now merely be described in more detail with reference to the drawing attached, which in a schematic, longitudinal section shows the main parts of a destruction facility of the type characteristic of the invention.

The destruction arrangement shown schematically in the drawing therefore comprises the actual detonation chamber 1, which at the top is provided with a charging aperture 2, which can be closed by means of a protective hatch 3. Opening into the charging aperture 2 is a charging tunnel 4, which is in turn outwardly closed off by a second openable protective hatch 5. For safety reasons the protective hatches 3 and 5 can only be opened one at a time. Together they thereby constitute a charging tunnel 4 to a protected charging lock. A made-up batch for destruction 6 is shown ready for charging into the detonation chamber 1 is shown inside the charging lock. The batch for destruction 6, which has been made up outside the charging lock 4, has for the sake of clarity been drawn in cross section. As can be seen from the drawing, the batch for destruction 6 comprises an outer, box-shaped container 7, in which the actual material for destruction is here drawn in the form of large-calibre artillery shell 8. A certain quantity of a gel explosive 9 and an electrical igniter 10 have furthermore been added to the container 7. The igniter 10 is in turn connected to a lowering cable 11, which in addition serves a dual function as electrical ignition cable for the electrical igniter 10. In the starting position the combined lowering and electrical igniter cable 11 is wound up on a cable reel 12, from which it runs over a first sheave 13. At the cable reel 12 electrically conductive parts of the lowering and electrical igniter cable 11 are connected to an ignition function in the form of a current source 14 and an initiation circuit-breaker 15.

The cable reel 12 is provided with a built-in brake function, which can be used to hold the container 7 carrying the batch for destruction 6 in any desired position through an extension of the cable 11. The charging lock 4 is in itself sufficiently inclined in relation to the horizontal plane to cause the container 7 to move down the lock without braking. If so desired, the charging lock 7 can also be provided with a special brake function, here denoted by 16, in order to keep the container 7 in the charging lock 4 until the catch 16 is reactivated.

When destruction is activated, the function is as follows: irrespective of whether it is the cable 11 that is slackened or the catch 16 that is reactivated, the container 7, as soon as the protective hatch 3 is opened, will move along a charging track 17, which represents a direct continuation of the charging lock 4. At the end of the charging track 17 the container 7 tips over the end edge whilst the cable 11 runs over a sheave 18 intended for this purpose, whereupon the container 7 suspended on the cable 11 is lowered down to the final position 19 shown in the drawing, in which position the igniter 10 is activated and the batch for destruction and the container 7 are converted into scrap metal. Undertaking the destruction at the centre of the detonation chamber minimizes the wear and tear to the detonation chamber. New containers 7 can be continuously made ready whilst destruction is in progress.

The invention claimed is:

1. Method for the destruction of obsolete ammunition in an explosion-proof detonation chamber for achieving an initiation of the constituent explosives of the obsolete ammunition, wherein the initiation of the constituent explosives is performed by an electrically activated initiation charge that is external to the obsolete ammunition and is delivered to the detonation chamber together with the obsolete ammunition by packing the obsolete ammunition, the electrically activated initiation charge, and a slurry or gel explosive into a liquid-tight, disposable container;

suspending the liquid-tight, disposable container from an electrically conductive ignition cable, the liquid-tight, disposable container being attached to said electrically conductive ignition cable and being provided with an electrical igniter; and conducting a current through the electrically conductive ignition cable to the electrical igniter.

2. Method according to claim 1, wherein the electrically conductive ignition cable is wound up on a cable reel, from which the electrically conductive ignition cable runs over a sheave, the cable reel comprising the electrical igniter.

3. Method according to claim 2, wherein the cable reel is provided with a break for holding the liquid-filled, disposable container in any desired position through selection of an extension of the electrically conductive ignition cable.

4. Method according to claim 1, wherein the explosion-proof detonation chamber further comprises a charging chute having openable protective hatches at a proximal end and a distal end of the charging chute, wherein only one of the openable protective hatches can be opened at a time.

5. Destruction arrangement for destruction of obsolete ammunition, comprising:

an explosion-proof detonation chamber provided with a charging lock for obsolete ammunition that is to be destroyed in said destruction arrangement, a liquid-tight, disposable container being provided with an electrical igniter and being attached to a hoist device comprising an electrically conductive ignition cable, and a hoist device for lowering the liquid-tight, disposable container down into the explosion-proof detonation chamber suspended on the electrically conductive ignition cable forming part of the hoist device together with elements for initiating the initiation charges delivered into the explosion-proof detonation chamber together with the obsolete ammunition and a slurry or gel explosive in the liquid-tight, disposable container.

6. Destruction arrangement according to claim 5, wherein the electrically conductive ignition cable is wound up on a cable reel, from which the electrically conductive ignition cable runs over a sheave where a conductive area of the cable is connected to the electrical igniter.

7. Destruction arrangement according to claim 6, wherein the cable reel is provided with a break function for holding the liquid-filled, disposable container in any desired position through selection of an extension of the electrically conductive ignition cable.

8. Destruction arrangement according to claim 5, wherein the charging lock comprises a charging chute having openable protective hatches at a proximal end and a distal end of the charging chute.

9. Destruction arrangement according to claim 8, wherein the charging chute further comprises a catch for the liquid-filled, disposable container.

* * * * *